US010279588B2

(12) United States Patent
Nakajima

(10) Patent No.: US 10,279,588 B2
(45) Date of Patent: May 7, 2019

(54) INKJET LINE PRINTER AND LINE HEAD

(71) Applicant: SEIKO EPSON CORPORATION, Tokyo (JP)

(72) Inventor: Yasumasa Nakajima, Nagano (JP)

(73) Assignee: Seiko Epson Corporation, tokyo (JP)

( * ) Notice: Subject to any disclaimer, the term of this patent is extended or adjusted under 35 U.S.C. 154(b) by 0 days.

(21) Appl. No.: 15/746,059

(22) PCT Filed: Jul. 6, 2016

(86) PCT No.: PCT/JP2016/003212
§ 371 (c)(1),
(2) Date: Jan. 19, 2018

(87) PCT Pub. No.: WO2017/013847
PCT Pub. Date: Jan. 26, 2017

(65) Prior Publication Data

US 2018/0207935 A1 Jul. 26, 2018

(30) Foreign Application Priority Data

Jul. 21, 2015 (JP) ..... 2015-143690

(51) Int. Cl.
*B41J 2/155* (2006.01)
*B41J 2/21* (2006.01)
*B41J 2/14* (2006.01)

(52) U.S. Cl.
CPC ..... *B41J 2/155* (2013.01); *B41J 2/14233* (2013.01); *B41J 2/2103* (2013.01); *B41J 2/2146* (2013.01)

(58) Field of Classification Search
CPC .... B41J 2/14233; B41J 2/2103; B41J 2/2146; B41J 2/155
See application file for complete search history.

(56) References Cited

U.S. PATENT DOCUMENTS 6,394,582 B1 5/2002 Koeda
6,416,162 B1 * 7/2002 Otsuki ..... B41J 2/2103 347/12
8,113,615 B2 2/2012 Nishihara
8,182,070 B2 * 5/2012 Hashimoto ..... B41J 2/155 347/13
8,489,521 B2 * 7/2013 Shiraiwa ..... G03G 21/02 705/400
9,308,752 B2 4/2016 Usuda et al.
9,415,595 B2 * 8/2016 Sudo ..... B41J 2/2139
(Continued)

FOREIGN PATENT DOCUMENTS

CN 103240987 A 8/2013
JP 07-329294 A 12/1995
(Continued)

*Primary Examiner* — Lamson D Nguyen

(57) ABSTRACT

Provided is a line inkjet printer capable of color printing using a simple configuration. A line inkjet printer has: a conveyance unit that, when printing, conveys at least one of a print medium and line head in a conveyance direction; and a line head having multiple nozzles that eject ink of one of N (where N is an integer of 2 or more) different colors arranged in a direction intersecting the conveyance direction, and configured to eject mutually different colors of ink from nozzles that are mutually adjacent along the direction intersecting the conveyance direction.

15 Claims, 15 Drawing Sheets

(56) References Cited

U.S. PATENT DOCUMENTS

| | | | |
|---|---|---|---|
| 2005/0018001 | A1 | 1/2005 | Murakami et al. |
| 2006/0284941 | A1 | 12/2006 | Murakami et al. |
| 2012/0162322 | A1 | 6/2012 | Tsuchiya et al. |
| 2013/0201266 | A1 | 8/2013 | Usuda et al. |
| 2014/0285572 | A1 | 9/2014 | Hanaoka et al. |
| 2015/0116424 | A1 | 4/2015 | Nagata et al. |

FOREIGN PATENT DOCUMENTS

| | | | |
|---|---|---|---|
| JP | 2005-014465 | A | 1/2005 |
| JP | 2006-051617 | A | 2/2006 |
| JP | 2006-168241 | A | 6/2006 |
| JP | 2009-012369 | A | 1/2009 |
| JP | 2012-131152 | A | 7/2012 |
| JP | 2014-184695 | A | 10/2014 |
| JP | 2015-093418 | A | 5/2015 |
| WO | 99/12739 | A1 | 3/1999 |

* cited by examiner

INKJET LINE PRINTER AND LINE HEAD

CROSS-REFERENCE TO RELATED APPLICATIONS

This application is a U.S. national phase application of International Patent Application No. PCT/JP2016/003212, filed on Jul. 6, 2016, which claims priority to Japanese Patent Application No. 2015-143690 filed on Jul. 21, 2015. The entire disclosures of Japanese Patent Application No. 2015-143690 is hereby incorporated herein by reference.

TECHNICAL FIELD

The present invention relates to an inkjet line printer and line head.

BACKGROUND

Inkjet printers include serial inkjet printers and line inkjet printers. A serial inkjet printer has a small printhead, and to print alternately executes a main scanning operation of ejecting ink droplets while moving the printhead widthwise to the print medium (in a main scanning direction), and a sub-scanning operation of moving the print medium (or printhead) in a sub-scanning direction intersecting the main scanning direction. A line inkjet printer, however, has a printhead (line head) large enough to eject ink droplets across the full width of the print medium, and when printing ejects ink droplets substantially simultaneously from the printhead across the full width of the print medium while conveying the print medium (or printhead) (see JP-A-2014-184695, for example). A line inkjet printer can print faster than a serial inkjet printer. Note that the ink ejection range of the line head does not necessarily need to cover the full width of all print media on which the line inkjet printer can print.

SUMMARY

To print in full color, a line inkjet printer such as described in JP-A-2014-184695 has four line heads, each ejecting one CMYK color. A problem with the line inkjet printer according to the related art is that because it has one line head for each color of ink, multiple line heads are required to print in color, printer construction is therefore complex, and cost increases accordingly. A line inkjet printer and line head enabling color printing by means of a configuration simpler than the related art are therefore desirable.

The present invention is directed to solving at least of the foregoing problem, and can be achieved by the embodiments and examples described below.

(1) A line inkjet printer is provided by one aspect of the invention. The line inkjet printer includes: a conveyance unit that, when printing, conveys at least one of a print medium and line head in a conveyance direction; and a line head having multiple nozzles that eject ink of one of N (where N is an integer of 2 or more) different colors arranged in a direction intersecting the conveyance direction, and configured to eject mutually different colors of ink from nozzles that are mutually adjacent along the direction intersecting the conveyance direction. This configuration enables color printing with a construction that is simpler than the related art because multiple colors of ink are ejected from a single line head.

(2) In the foregoing line inkjet printer, the line head does not need to move in the direction intersecting the conveyance direction when printing. This configuration enables color printing with a construction that is simpler than the related art.

(3) In the foregoing line inkjet printer, of the multiple nozzles, the multiple same-color nozzles ejecting the same color of ink are disposed at a constant same-color nozzle pitch. This configuration enables color printing with simple control at a constant print resolution.

(4) In the foregoing line inkjet printer, each of N same-color nozzle groups ejecting N different colors of ink are disposed at a mutually identical constant same-color nozzle pitch. This configuration enables color printing with a simple configuration because N same-color nozzle groups are arranged at a mutually equal, constant same-color nozzle pitch.

(5) In the foregoing line inkjet printer, N is an integer of 4 or more; and of N same-color nozzle groups ejecting N different colors of ink, the black nozzle group ejecting black ink is disposed at a same-color nozzle pitch that is smaller than the other same-color nozzle groups ejecting a chromatic color ink. This configuration can improve the quality of black and white printing because the black nozzle group is disposed at a smaller same-color nozzle pitch than the other same-color nozzle groups.

(6) In the foregoing line inkjet printer, the other same-color nozzle group may include a cyan nozzle group ejecting cyan ink, a magenta nozzle group ejecting magenta ink, and a yellow nozzle group ejecting yellow ink; and the same-color nozzle pitch NP2 of the black nozzle group is ⅓ of the same-color nozzle pitch NP1, where NP1 is the same-color nozzle pitch of the cyan nozzle group, magenta nozzle group, and yellow nozzle group. This configuration can improve the quality of black and white printing because the black nozzle group is disposed at a small same-color nozzle pitch.

(7) In the foregoing line inkjet printer, the line head may be configured with one nozzle row disposed in a line in the direction intersecting the conveyance direction. This configuration enables configuring a line inkjet printer with a simple construction because a line head capable of ejecting multiple colors of ink is configured with a single nozzle row.

(8) In the foregoing line inkjet printer, the line head may be configured with two nozzle rows each disposed in a line in the direction intersecting the conveyance direction; the two nozzle rows eject mutually different colors of ink; and at least one of the two nozzle rows ejects multiple different colors of ink. This configuration enables color printing with a higher print resolution or using more colors of ink because the line head is configured to eject multiple colors of ink from two nozzle rows.

(9) In the foregoing line inkjet printer, the line head may be configured with multiple head unit modules disposed to mutually offset positions in the direction intersecting the conveyance direction; and each head unit module of the multiple head unit modules is configured with one nozzle row in a line in the direction intersecting the conveyance direction. This configuration enables configuring a line head with a simple construction because a single line head is configured from multiple head unit modules.

(10) In the foregoing line inkjet printer, the line head is configured with multiple head unit modules disposed to mutually offset positions in the direction intersecting the conveyance direction; each head unit module of the multiple head unit modules is configured with two nozzle rows in a line in the direction intersecting the conveyance direction; the two nozzle rows eject mutually different colors of ink; and at least one of the two nozzle rows ejects multiple different colors of ink. This configuration enables configuring a line head with a simple construction because a single line head is configured from multiple head unit modules. Furthermore, color printing with a higher print resolution or using more colors of ink is also possible because each head unit module is configured with two nozzle rows.

(11) The foregoing line inkjet printer may also have a head driver that drives the line head to eject ink; the head driver causing the line head to eject ink droplets to form on the print medium ink dots of a size larger than the same-color nozzle pitch of the respective multiple same-color nozzles. This configuration enables printing continuous solid lines by forming ink dots of a size larger than the same-color nozzle pitch of the nozzles.

(12) In the foregoing line inkjet printer, the head driver is capable of solid printing in N colors on the print medium by causing the line head to eject ink droplets to form on the print medium ink dots of a large size. This configuration enables printing to the desired print density, including solid printing, by forming ink dots of a size larger than the same-color nozzle pitch of the same-color nozzles.

(13) The foregoing line inkjet printer may also have an oscillator that, by causing the line head to vibrate in a direction intersecting the conveyance direction, causes the landing position where ink droplets ejected from the line head land on the print medium to zigzag. This configuration can form a more uniform distribution of ink dots on the print medium by changing the landing position of the ink droplets in a zigzag pattern.

(14) In the foregoing line inkjet printer, the oscillator may cause the landing position to zigzag by causing the line head to oscillate in a direction intersecting the conveyance direction; and the line head, except for vibration of the oscillator, does not move in the direction intersecting the conveyance direction when printing. This configuration enables color printing by a simpler configuration than the related art.

(15) In the foregoing line inkjet printer, the line inkjet printer may be a receipt printer that prints receipts.

(16) In the foregoing line inkjet printer, the line inkjet printer may be a tape writer that prints on a print medium tape having a printing surface and an adhesive surface for affixing the tape to an object.

(17) A line head is provided by another aspect of the invention. The line head has multiple nozzles arrayed in a line; and a fluid chamber corresponding to each of N (where N is an integer of 2 or more) colors of ink; of the multiple nozzles, mutually adjacent nozzles communicate with fluid chambers of different colors; and of the multiple nozzles, nozzles communicating with a fluid chamber of the same color are disposed to repeat at a constant same-color nozzle pitch. This configuration enables color printing with a construction that is simpler than the related art because multiple colors of ink are ejected from a single line head.

(18) A line head is provided by another aspect of the invention. This line head is a line head that moves relative to a print medium and ejects ink, has multiple nozzles aligned in a direction intersecting the direction of movement of the medium; is configured to eject mutually different colors of ink from nozzles that are mutually adjacent in the group of multiple nozzles; and of the multiple nozzles, the nozzles that eject the same color of ink are distributed in the range of a nozzle row including multiple nozzles. This configuration enables color printing with a construction that is simpler than the related art because multiple colors of ink are ejected from a single line head.

(19) A line head is provided by another aspect of the invention. This line head is a line head for an inkjet printer, includes multiple nozzles aligned along the length of the head; the line head is capable of ejecting N (where N is an integer of 2 or more) different colors of ink; and the multiple nozzles are arranged to eject mutually different colors of ink from nozzles that are mutually adjacent in the direction along the length. This configuration enables color printing with a construction that is simpler than the related art because multiple colors of ink are ejected from a single line head.

The invention can be embodied in many ways, including, for example, in addition to a line inkjet printer, a line head, a receipt printer, and a tape writer.

DESCRIPTION OF EMBODIMENTS

Embodiment 1

Figure 1:
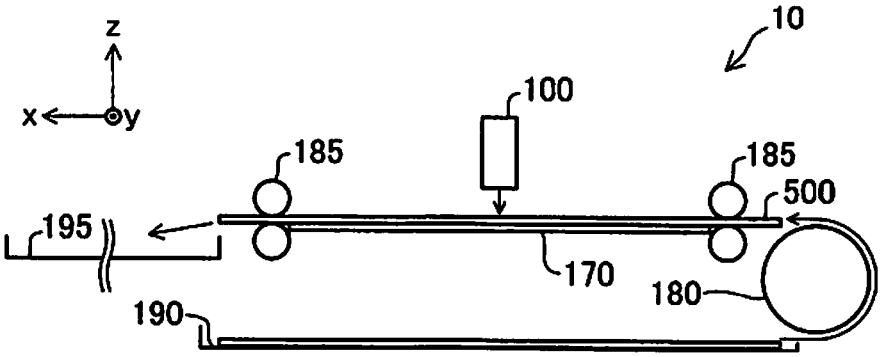
FIG. 1 schematically illustrates a line inkjet printer.

FIG. 1 schematically illustrates a line inkjet printer 10. The line inkjet printer 10 (referred to below as simply printer 10) has a line head 100, platen 170, paper supply roller 180, paper conveyance rollers 185, paper cassette 190, and exit tray 195. The line head 100 is a device that ejects ink to the paper 500 used as the print medium. The paper cassette 190 stores the paper 500 before printing. The paper 500 corresponds to the print medium. The paper supply roller 180 is a roller for feeding paper one sheet at a time from the paper cassette 190. The paper conveyance rollers 185 are an example of a conveyance unit, and convey the paper 500 from the paper cassette 190, between the line head 100 and platen 170, and to the exit tray 195. This direction in which the paper 500 conveys the paper is called the conveyance direction. The exit tray 195 is the destination to which the printed paper 500 is discharged. The printer 10 in this embodiment is configured to use cut paper as the paper 500, but may be configured to use roll paper. In this case, a paper roll is used instead of the paper cassette 190. Also shown in FIG. 1 are the conveyance direction x of the paper 500, width direction y of the paper 500, and axis z perpendicular to the conveyance direction x and width direction y axes. The printer 10 in this embodiment uses a paper conveyance mechanism using paper conveyance rollers 185 as the conveyance unit, but may use a paper conveyance method that uses a belt. Further alternatively, instead of printing by conveying the paper 500, the line head 100 may be moved in the conveyance direction.

When printing, the conveyance unit moves either the paper 500 or the line head 100. This means that the paper 500 and line head 100 move relative to each other. When printing, the line head 100 does not move in a direction intersecting the conveyance direction. As a result, unlike a serial inkjet printer, because the line head 100 does not move in the main scanning direction, the construction of the inkjet printer is simplified. High speed printing is also possible. Note that technology enabling maintenance of the line head 100 by moving the line head 100 in a different direction than the conveyance direction is known, but this movement of the line head 100 is for maintenance, and is not movement while printing.

Figure 2A:
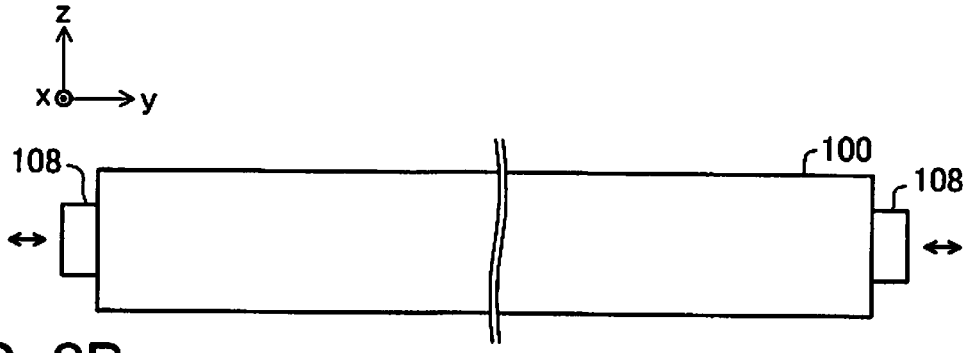
FIGS. 2A and 2B schematically illustrate a line head.
Figure 2B:
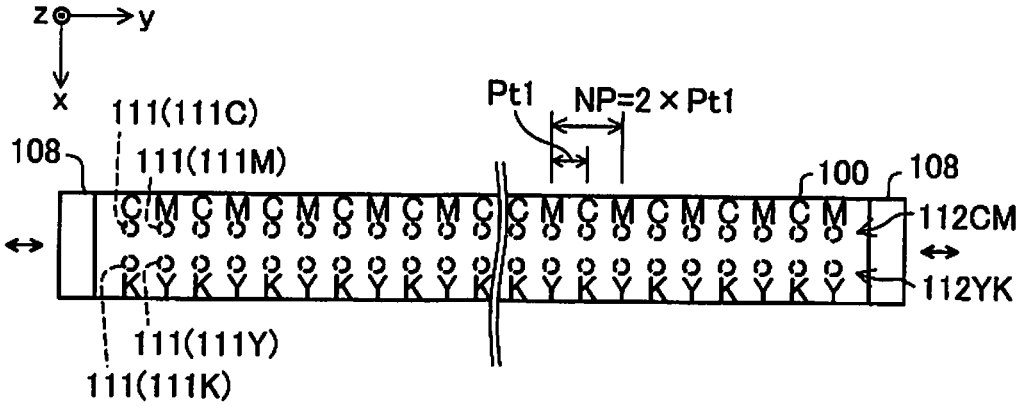

FIGS. 2A and 2B schematically illustrates the line head 100. FIG. 2A is a front view of the line head 100 from the conveyance direction x, and FIG. 2B is a bottom view of the line head 100. The line head 100 has multiple nozzles 111. The multiple nozzles 111 are arrayed in two rows along the width direction Y of the printhead, which corresponds to the width direction Y of the paper 500, forming nozzle rows 112CM and 112YK in two lines. The direction in which the multiple nozzles 111 are arrayed is referred to as the nozzle row direction. The nozzles 111 are separated by the color of ink they eject into four groups: cyan nozzles 111C (referred to as simply nozzles 111C); magenta nozzles 111M (referred to as simply nozzles 111M); yellow nozzles 111Y (referred to as simply nozzles 111Y); and black nozzles 111K (referred to as simply nozzles 111K). Because there are multiple nozzles 111C, 111M, 111Y, and 111K, the nozzles are respectively referred to as a cyan nozzle group, magenta nozzle group, yellow nozzle group, and black nozzle group. Note that terms referring to nozzles 111 without a C, M, Y, or K index are generic terms. Nozzle row 112CM includes nozzles 111C and 111M, and nozzle row 112YK includes nozzles 111Y and 111K. In nozzle row 112CM, nozzles 111C, 111M are arranged to eject different colors of ink from every other nozzle in the head width direction y. Likewise, in nozzle row 112YK, nozzles 111Y, 111K are arranged to eject different colors of ink from every other nozzle in the head width direction y. As a result, nozzles ejecting the same color of ink repeat at a specific nozzle pitch NP (referred to below as same-color nozzle pitch NP). For example, if the nozzle pitch of nozzles that eject different colors of ink is Pt1, the same-color nozzle pitch NP of two nozzles 111M for magenta ink is (2×Pt1). The same-color nozzle pitch NP is the center-to-center distance between the two adjacent nozzles 111 ejecting the same color of ink. The same-color nozzle pitch NP of two nozzles 111C for cyan ink, the same-color nozzle pitch NP of two nozzles 111Y for yellow ink, and the same-color nozzle pitch NP of two nozzles 111K for black ink, is also (2×Pt1). Note that the constant same-color nozzle pitch NP may contain some error (tolerance) for machining precision, or deviation of a degree not affecting print quality.

The head width direction y intersects the conveyance direction x of the paper 500, and is equivalent to the main scanning direction in a serial inkjet printer. More specifically, the multiple nozzles 111 can be said to be aligned in a direction intersecting the conveyance direction x, and aligned with the length of the line head 100. Nozzles 111 of the same color are distributed through the extent of the nozzle row.

An oscillator 108 is disposed on both sides of the line head 100. The oscillator 108 causes the line head 100 to vibrate in the head width direction y. In this embodiment of the invention, an oscillator 108 is disposed on each side of the line head 100, but an oscillator 108 may be disposed anywhere it can cause the line head 100 to vibrate in the head width direction y. How the oscillator 108 is used is described below.

Figure 3A:
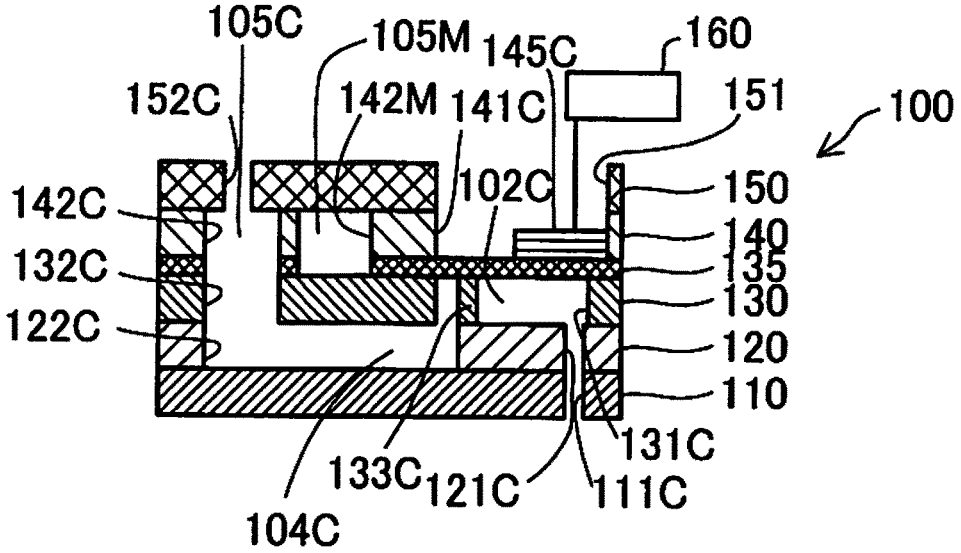
FIGS. 3A and 3B show the line head in cross section.
Figure 3B:
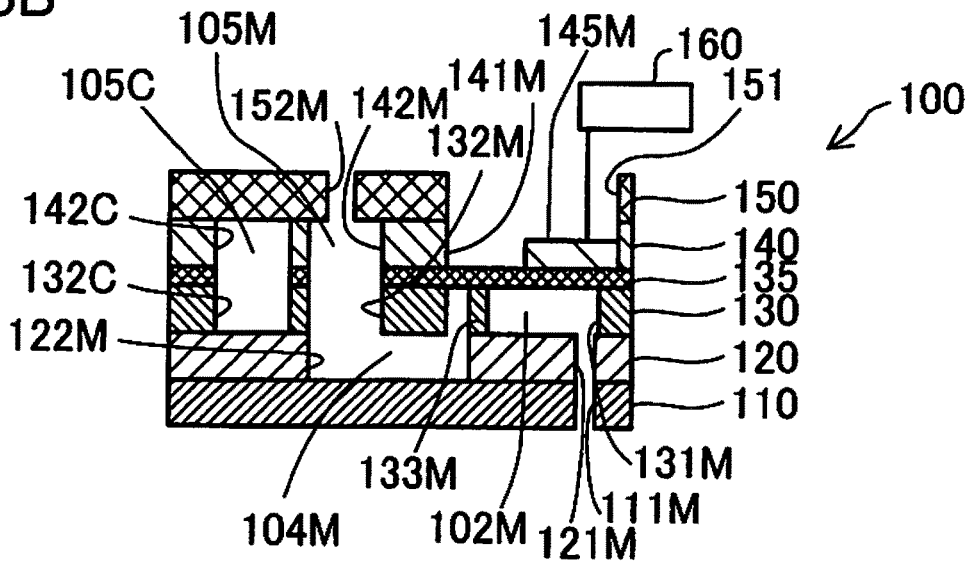
Figure 4A:
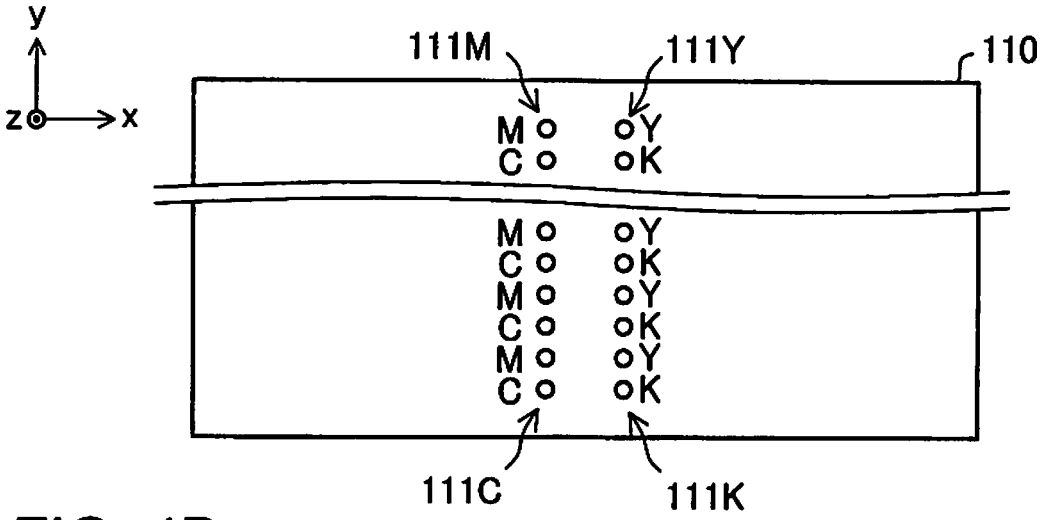
FIGS. 4A, 4B and 4C show the first substrate, second substrate, and third substrate in FIGS. 3A and 3B.
Figure 4B:
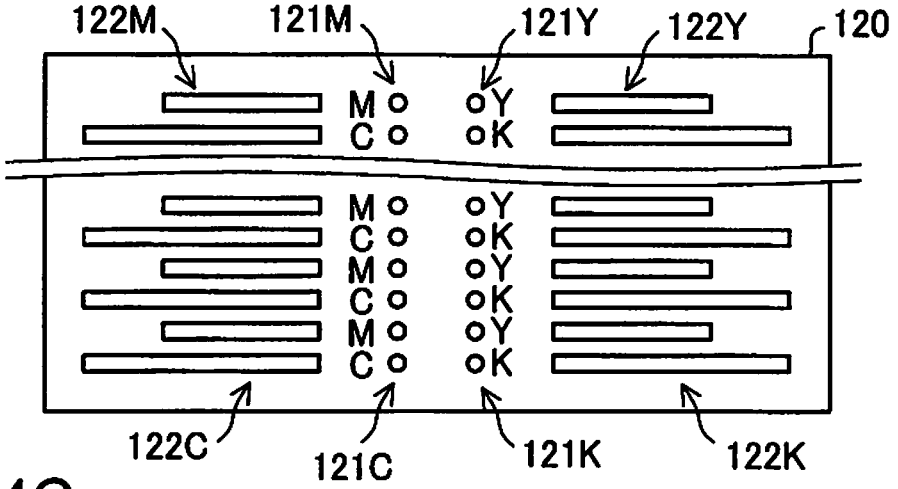
Figure 4C:
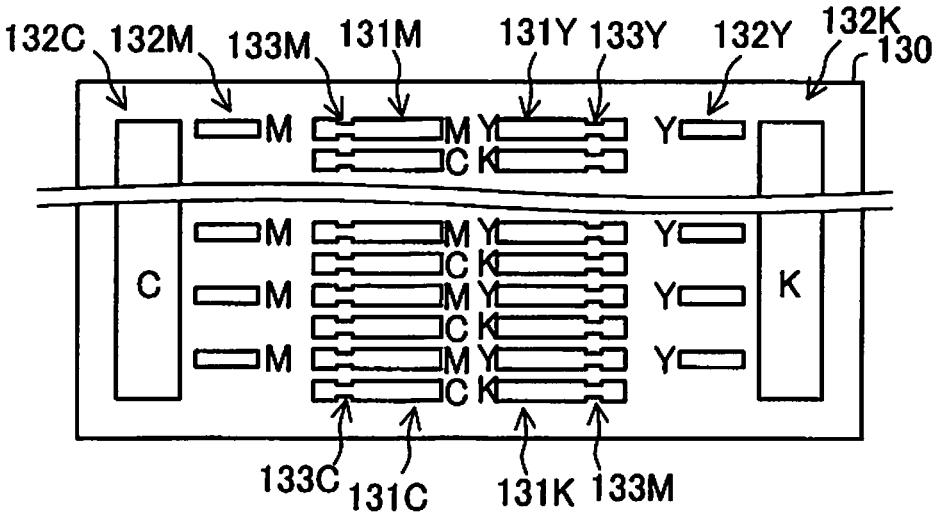

FIGS. 3A and 3B are section views of the line head 100. FIGS. 4A, 4B and 4C describe the first substrate 110, second substrate 120, and third substrate 130 in FIGS. 3A and 3B, and FIGS. 5A, 5B and 5C describe the fourth substrate 135, fifth substrate 140, and sixth substrate 150 in FIGS. 3A and 3B. FIG. 3A is a section view through the nozzles 111C that eject cyan ink, and FIG. 3B is a section view through the nozzles 111M that eject magenta ink. Note that because the section in FIGS. 3A and 3B through the nozzles 111Y that eject yellow ink, and the section through nozzles 111K that eject black ink, are identical to the configurations shown in FIGS. 3A and 3B, the section through nozzles 111C and the section through nozzles 111M are described below, and further description and depiction of the section through nozzles 111Y and the section through nozzles 111K is omitted.

The line head 100 is constructed by combining in layers, from the bottom of the line head 100 (FIG. 2B), six substrates 110, 120, 130, 135, 140, 150 (FIGS. 4A-4C, FIGS. 5A-5C). Inside the line head 100 are a pressure chamber 102C, flow channel 104C, and fluid chamber 105C for cyan ink; and a pressure chamber 102M, flow channel 104M, and fluid chamber 105M for magenta ink. The length of the flow channel 104C for cyan ink, and the length of the flow channel 104M for magenta ink, are different.

As shown in FIG. 4A, the first substrate 110 is a nozzle plate having nozzle holes for nozzles 111C, 111M, 111Y, 111K. Nozzles 111C and 111M are aligned with the width direction y of the line head 100. Nozzles 111Y and 111K are identically configured.

As shown in FIG. 4B, the second substrate 120 has substantially round holes 121C, 121M, 121Y, 121K formed at positions corresponding to the nozzle openings in the first substrate 110, and slotted openings 122C, 122M, 122Y, 122K configuring ink flow channels. The substantially round hole 121C communicates with the pressure chamber 102C (FIG. 3A) and nozzle 111C. Holes 121M, 121Y, 121K are configured the same. The slotted opening 122C forms flow channel 104C (FIG. 3A). Openings 122K, 122Y, 122K are configured the same. In this embodiment of the invention, the length of slotted openings 122C, 122K in the conveyance direction x is greater than the length of slotted openings 122M, 122Y in the conveyance direction x. As a result, the length of the flow channel 104C for cyan ink, and the length of the flow channel 104M for magenta ink, are different. The lengths of these openings 122C, 122M, 122Y, 122K are different because the distance to the fluid chambers 105C, 105M, 105Y, 105K in the line head 100 is different.

As shown in FIG. 4C, the third substrate 130 has slotted openings 131C, 131M, 131Y, 131K for forming pressure chambers, and openings 132C, 132M, 132Y, 132K forming part of the ink flow paths. Openings 132C, 132K are a single large opening in the width direction y, but openings 132M, 132Y are slots separated into multiple parts. The slotted openings 131C, 131M, 131Y, 131K each have a constricted part 133C, 133M, 133Y, 133K narrowing the width of the slot. The pressure chamber 102C shown in FIG. 3A is formed using the part of the opening 131C closer to the nozzle 111C side than the constricted part 133C. As described above, the pressure chamber 102C communicates through the hole 121C with the nozzle 111C side. The part of the opening 131C on the opposite side of the constricted part 133C as the nozzle 111C communicates with the opening 122C in the second substrate 120. Openings 131M, 131Y, 131K are likewise configured. Opening 132C communicates with the fluid chamber 105C and flow channel 104C. Openings 132M, 132Y, 132K are likewise configured. Note that, as described above, openings 132M, 132Y are segmented into multiple parts, and are smaller and shaped differently than openings 132C, 132K. This is because if the openings 132M, 132Y are formed as a single large opening similarly to openings 132C, 132K, they will communicate with the openings 122C, 122K in the second substrate 120, and different colors of ink will be mixed. To avoid this, openings 132M, 132Y are separated into multiple parts. Note that openings 132C, 132K may be formed as slots similarly to openings 132M, 132Y.

Figure 5A:
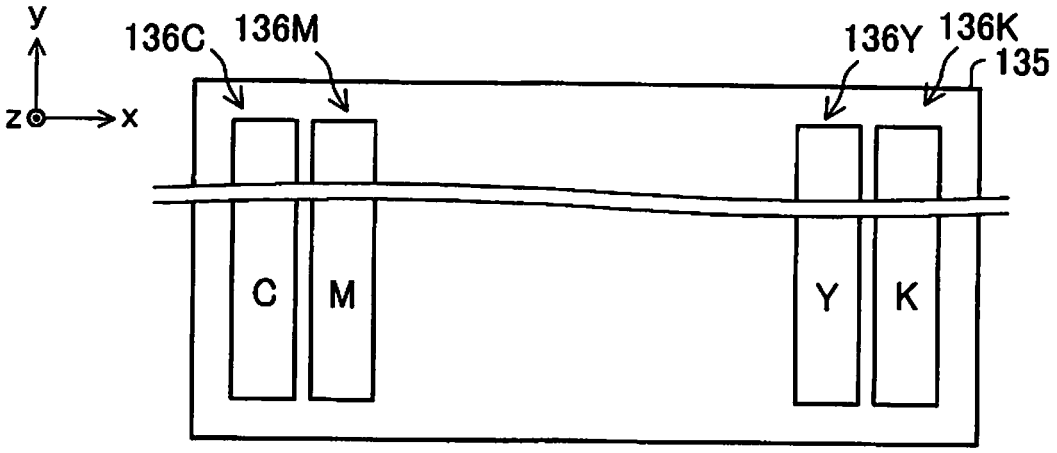
FIGS. 5A, 5B and 5C describe the fourth substrate, fifth substrate, and sixth substrate in FIGS. 3A and 3B.

As shown in FIG. 5A, the fourth substrate 135 has large openings 136C, 136M, 136Y, 136K formed in the width direction y. Opening 136C communicates with flow channel 104C and fluid chamber 105C. Openings 136M, 136Y, 136K are similarly configured. The fourth substrate 135 functions as an oscillation plate. Note that because openings 136C, 136M, 136Y, 136K are the same size as the fluid chamber 105C, 105M, 105Y, 105K in the conveyance direction x and width direction y, they may be characterized as part of the fluid chambers 105C, 105M, 105Y, 105K instead of communication channels.

Figure 5B:
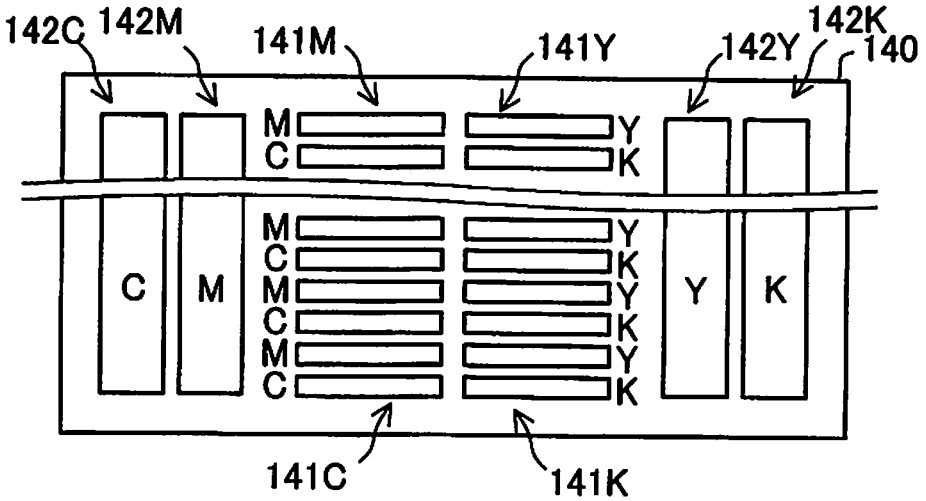

As shown in FIG. 5B, the fifth substrate 140 has slotted openings 141C, 141M, 141Y, 141K for disposing a piezoelectric actuator, and large openings 142C, 142M, 142Y, 142K configuring fluid chambers. A piezoelectric actuator 145C (FIG. 3A) is disposed in the openings 141C. The piezoelectric actuator 145C is driven by a head driver 160. When a drive signal of a specific waveform is applied to the piezoelectric actuator 145C from the head driver 160, the piezoelectric actuator 145C causes the fourth substrate 135 to vibrate as an oscillator. The fourth substrate 135 thus deforms and cyan ink in the pressure chamber 102C is ejected from the nozzle 111C. By changing the waveform of the drive signal, ink droplets of different sizes can be ejected from the nozzle 111C. Openings 141M, 141Y, 141K are likewise configured. Opening 142C forms fluid chamber 105C. Openings 142M, 142Y, 142K are similarly configured.

Figure 5C:
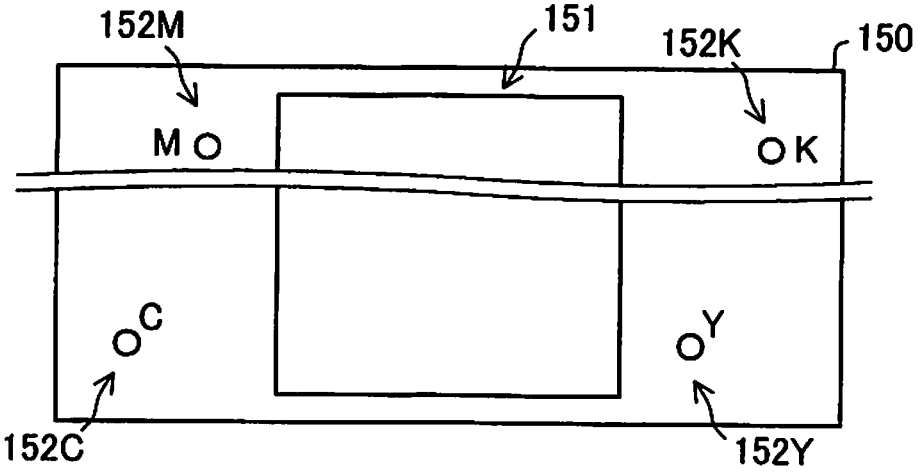

As shown in FIG. 5C, the sixth substrate 150 has a large opening 151, and substantially round openings 152C, 152M, 152Y, 152K. The large opening 151 is used as a space to dispose piezoelectric actuators 145C, 145M, 145Y, 145K in the line head 100. Opening 152C forms an ink flow channel for sending cyan ink from the ink cartridge (not shown in the figure) to the fluid chamber 105C. Openings 152M, 152Y, 152K are similarly configured. Note that while not shown in the figures, the piezoelectric actuators 145C, 145M, 145Y, 145K each have a common electrode and an individual electrode, and are driven by a drive signal from the head driver 160 applied between the common electrode and an individual electrode.

Figure 6:
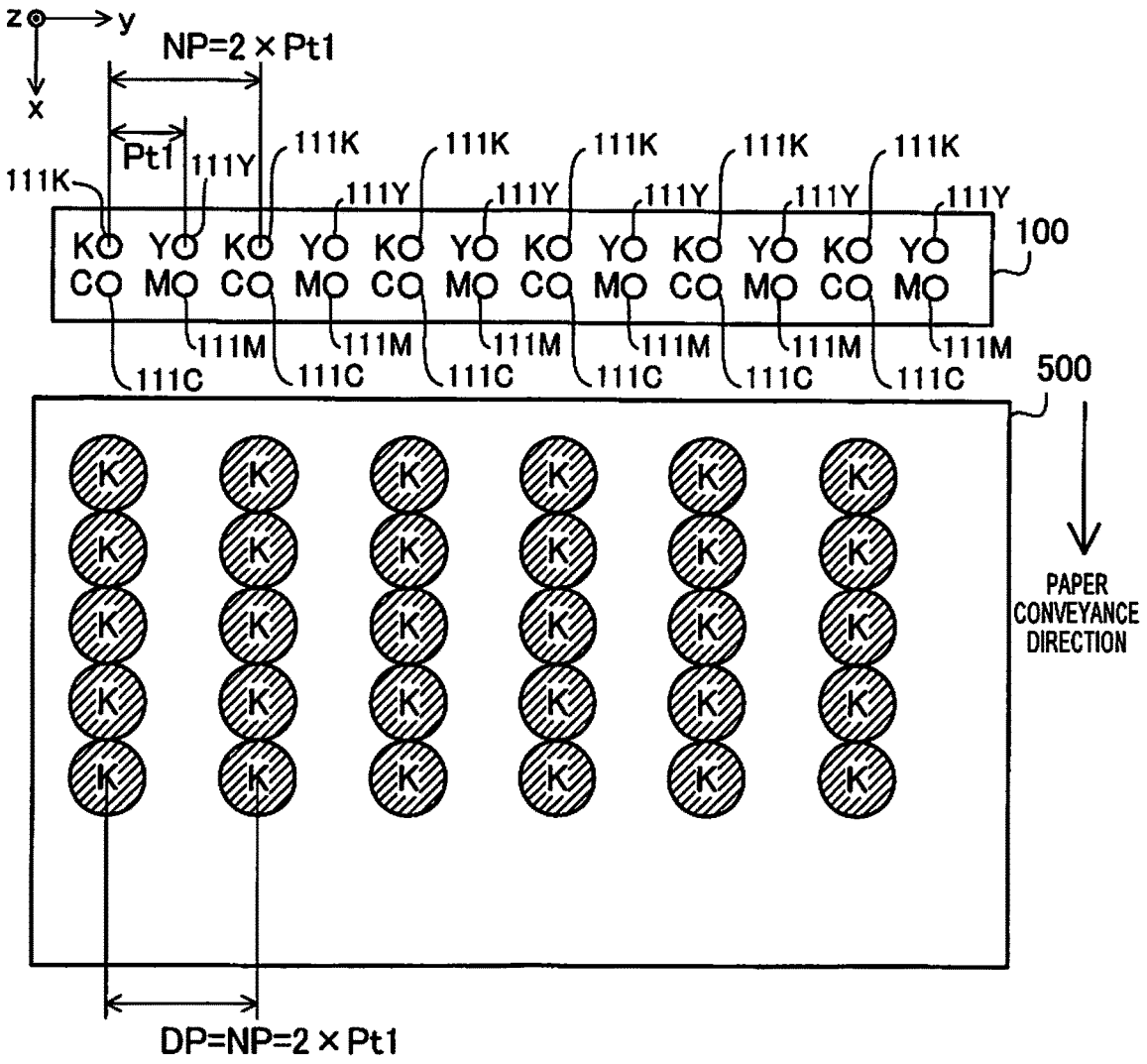
FIG. 6 shows an example of ink dots printed on paper in the first embodiment of the invention.

FIG. 6 shows an example of ink dots printed on the paper 500 in the first embodiment of the invention. FIG. 6 describes printing black dots, and for convenience the number of nozzles is less than actual. Other colors of dots are the same. Other print samples described below also use the example of black dots. In FIG. 6, if the nozzle pitch is Pt1, the same-color dot pitch DP is equal to the same-color nozzle pitch NP of 2Pt1. In this example, if the nozzle pitch Pt1 is 600 dpi, the same-color dot pitch DP is 300 dpi.

Figure 7:
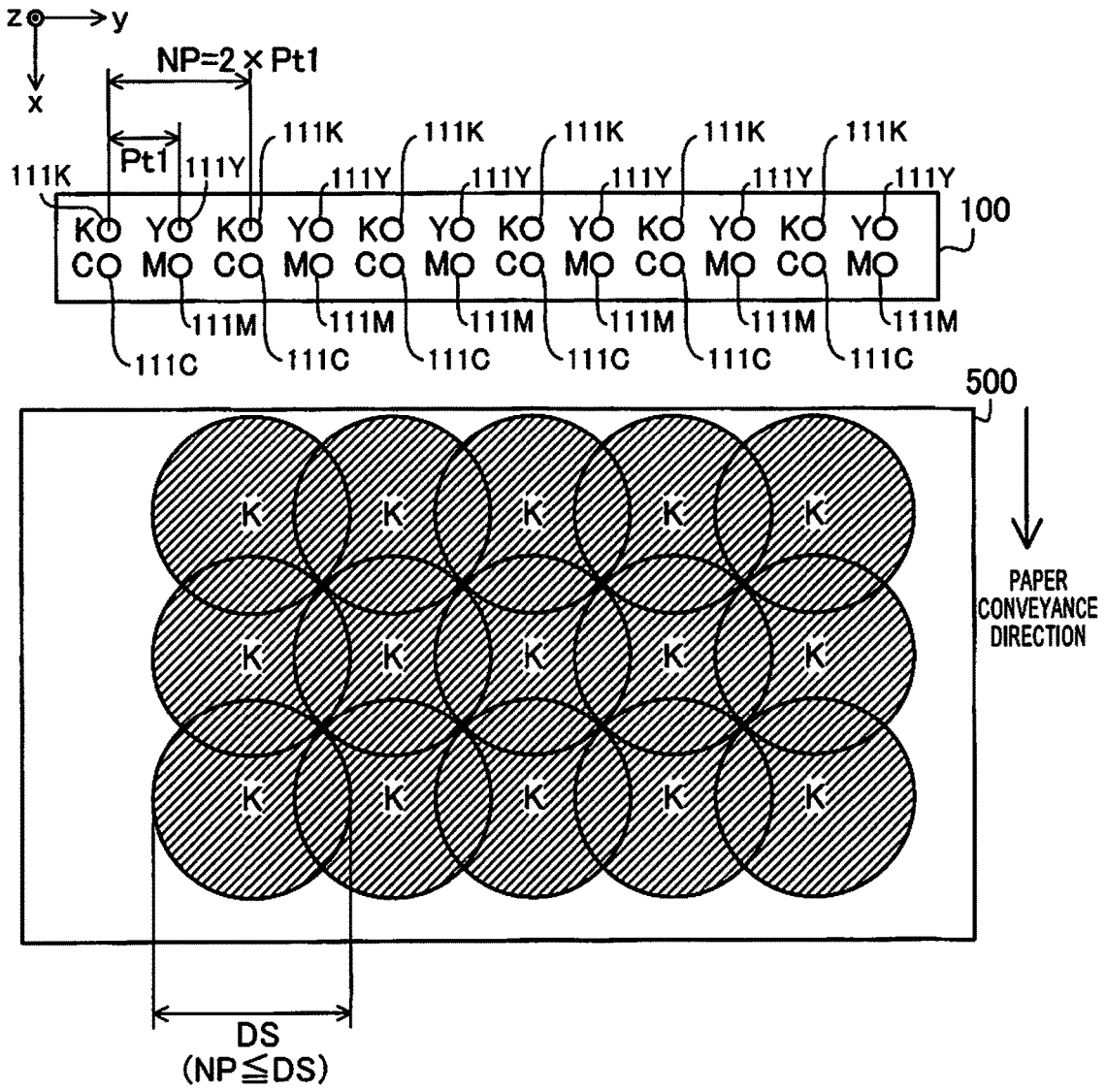
FIG. 7 shows an example of large dots printed in the first embodiment.

FIG. 7 shows an example of large dots printed in the first embodiment. In the example in FIG. 7, the dot size DS is greater than the same-color nozzle pitch NP, and is a size enabling solid printing. Note that the dot size DS need not be as large as illustrated in FIG. 7. For example, if the dot size DS is greater than or equal to the same-color nozzle pitch NP, a solid continuous line can be printed. This embodiment also uses black ink for example, and other colors of ink can also be printed at desirable print density enabling printing solid continuous lines and solid printing.

Figure 8:
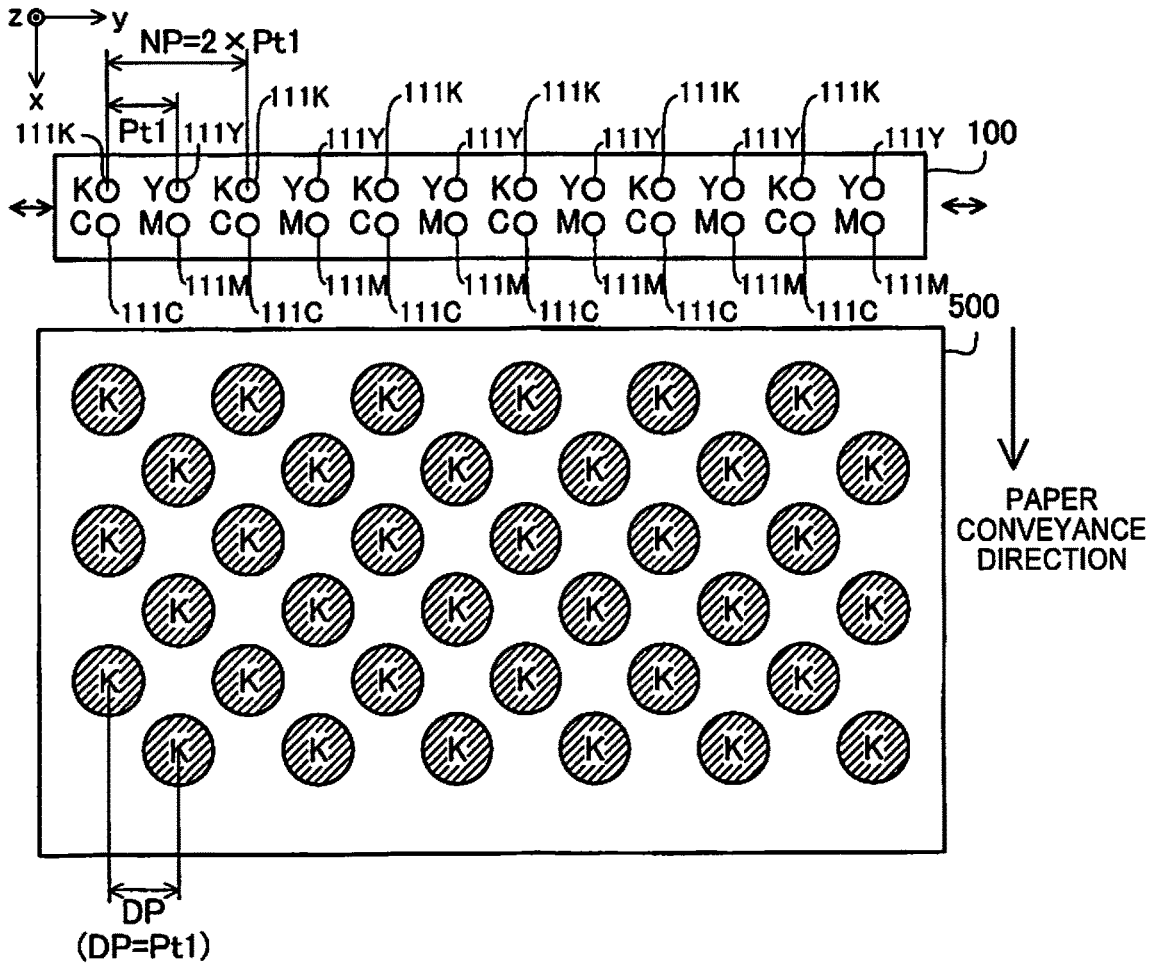
FIG. 8 shows an example of printing by operating an oscillator in the first embodiment of the invention.

FIG. 8 shows an example of printing by operating the oscillator 108 (FIG. 2A) in the first embodiment. Compared with the example in FIG. 6, the landing position in the width direction y of dots on even-numbered rows is between the landing position in the width direction y of dots on odd-numbered rows, and the dots are thus placed in a zigzag pattern. As a result, ink dots can be formed in a uniform distribution on the print medium, and print quality can be improved.

Figure 9:
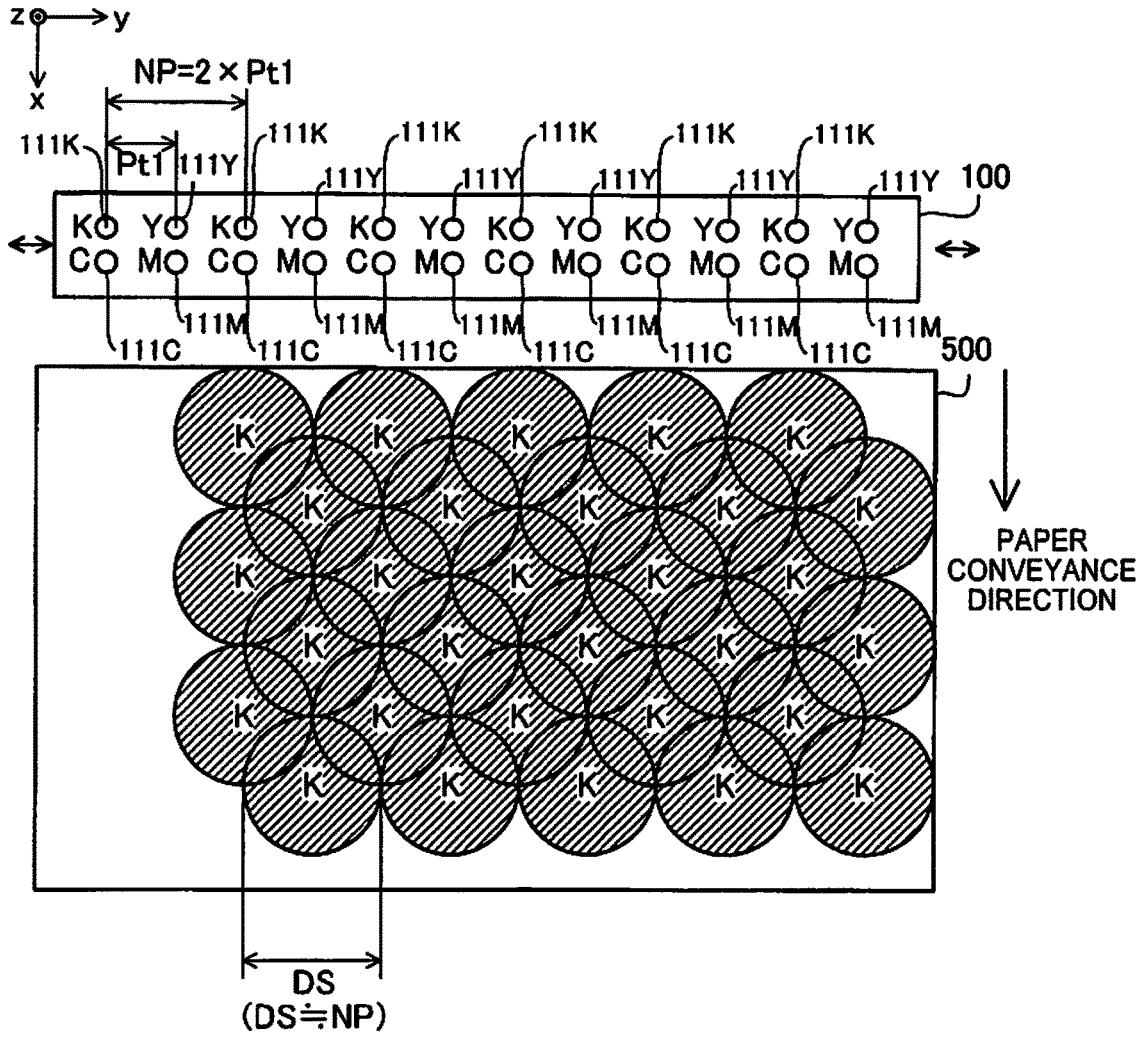
FIG. 9 shows an example of printing large dots by operating an oscillator in the first embodiment of the invention.

FIG. 9 shows another example of large dots printed by operating the oscillator 108 in the first embodiment. In the example in FIG. 9, the dot size DS is substantially the same as the same-color nozzle pitch NP. Compared with the example in FIG. 7, recording dots by operating the oscillator 108 as shown in FIG. 9 achieves the same print density while reducing the dot size. Note that printing by operating the oscillator 108 is done to improve the print quality and described above, and vibration of the line head 100 by the oscillator 108 is not the movement of the head in the main scanning direction in order to print as in a serial inkjet printer.

The line head 100 of a line inkjet printer 10 according to the first embodiment of the invention has multiple nozzles 111C, 111M, 111Y, 111K arrayed in the head width direction y, which is the same as the width direction y of the paper 500 (print medium). The line head 100 can eject ink of N different colors (where N is an integer of 2 or more, and in this embodiment N=4), and the multiple nozzles 111C, 111M, 111Y, 111K are disposed in the head width direction Y so that different colors of ink are ejected from mutually adjacent nozzles. As a result, color printing is possible using a configuration that is simpler than a color printing configuration having multiple line heads each ejecting one color of ink. Furthermore, because a line head capable of ejecting multiple colors of ink is configured with two nozzle rows 112CM, 112YK, color printing at a high print resolution or a greater number of inks is possible.

Furthermore, because same-color nozzles that eject the same color of ink, such as nozzles 111C, are disposed at a constant same-color nozzle pitch NP, color printing can be easily controlled to achieve a constant print resolution. This also applies to the other nozzles 111M, 111Y, 111K.

In the embodiment described above the two nozzle rows 112CM, 112YK both eject plural different colors of ink, but a configuration in which at least one of the two nozzle rows ejects plural different colors of ink is also conceivable. For example, one nozzle row may have nozzles 111C, 111M, 111Y for three colors of ink, and the other nozzle row may have nozzles 111K for one color of ink.

Embodiment 2

Figure 10A:
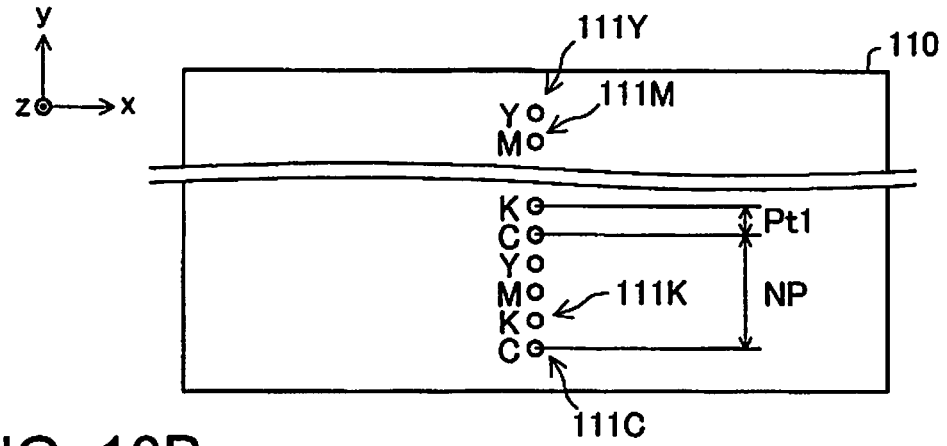
FIGS. 10A, 10B and 10C describe the first substrate, second substrate, and third substrate in a second embodiment of the invention FIGS. 11A, 11B and 11C describe the fourth substrate, fifth substrate, and sixth substrate in a second embodiment of the invention FIGS. 12A, 12B and 12C describe the first substrate, second substrate, and third substrate in a third embodiment of the invention FIGS. 13A, 13B and 13C describe the fourth substrate, fifth substrate, and sixth substrate in a third embodiment of the invention
Figure 10B:
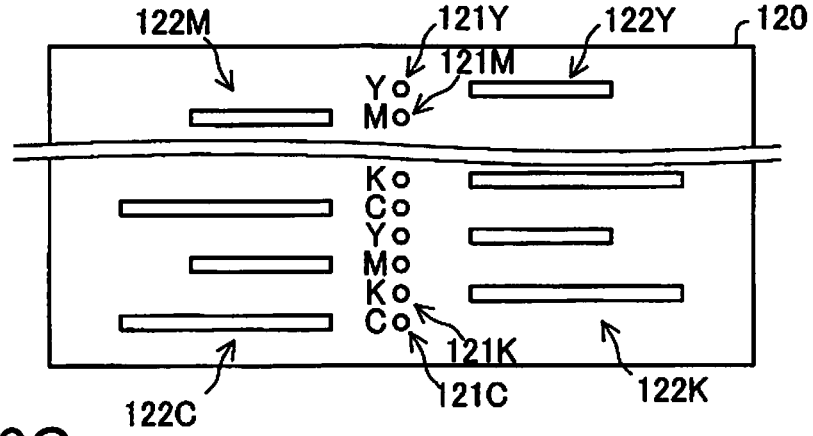
Figure 10C:
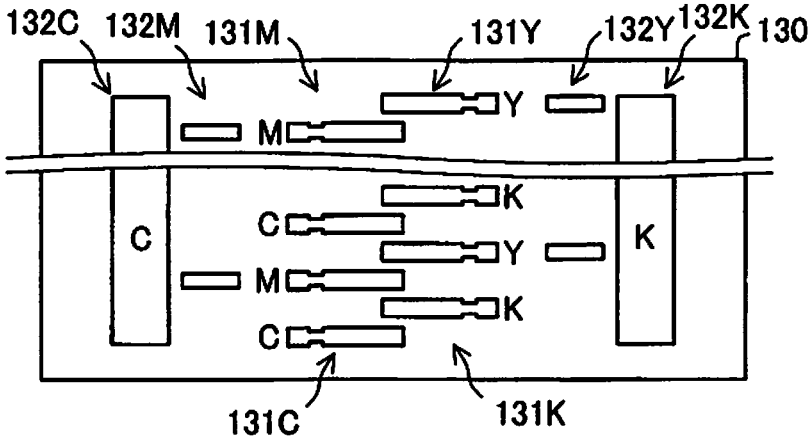
Figure 11A:
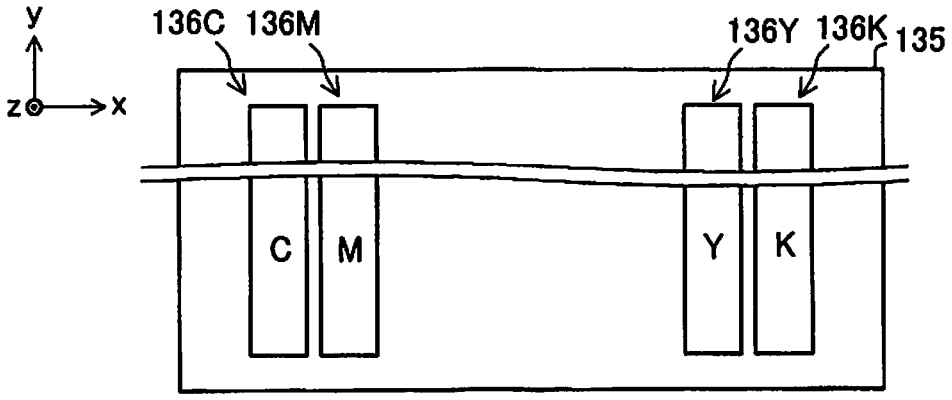
Figure 11B:
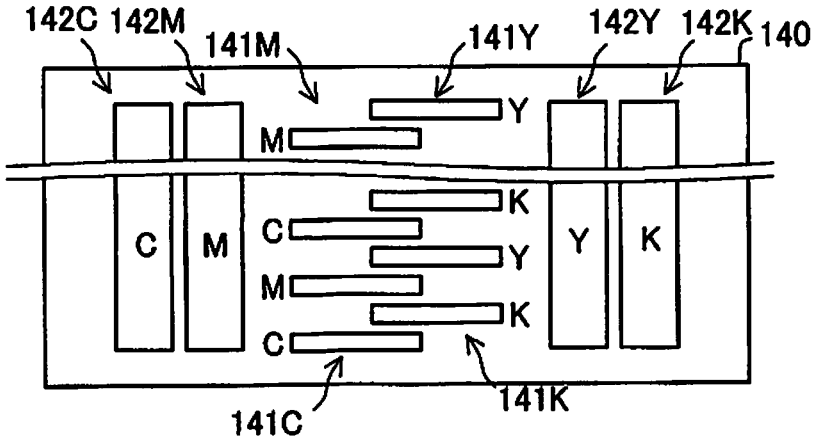
Figure 11C:
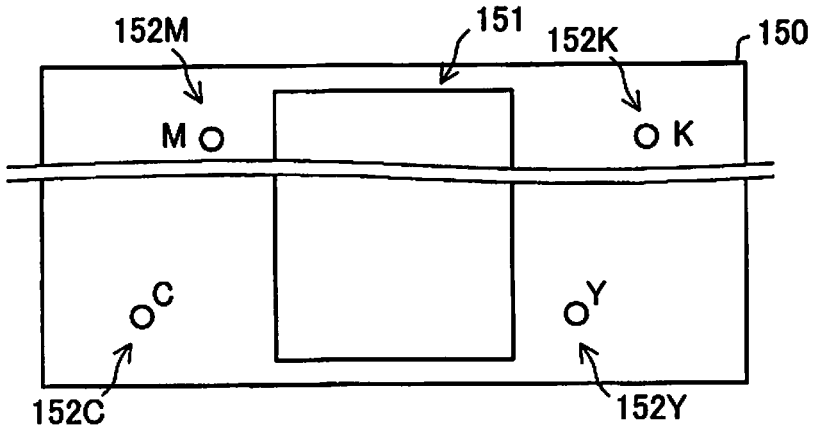

FIGS. 10A to 10C describe the first substrate 110, second substrate 120, and third substrate 130 in a second embodiment of the invention, and FIGS. 11A to 11C describe the fourth substrate 135, fifth substrate 140, and sixth substrate 150 in the second embodiment. The line head 100 (FIGS. 2A and 2B) in the first embodiment described above has two nozzle rows 112CM, 112YK in respective lines, but there is only one nozzle row in this second embodiment. More specifically, nozzles 111C, 111M, 111Y, 111K for all colors of ink are formed in a single row. The same-color nozzle pitch NP is four times nozzle pitch Pt1. Because there is only one nozzle row instead of two, the openings and constricted parts of the first substrate 110 to sixth substrate 150 are shifted closer to the center of the conveyance direction x, and the sequence in the width direction y is different from the first embodiment, but the configuration is otherwise the same and further description thereof is omitted.

Because multiple colors of ink are ejected from a 1-line line head 100 in this second embodiment of the invention, color printing is possible using a configuration that is simpler than a color printing configuration having multiple line heads each ejecting one color of ink.

Furthermore, because nozzles that eject the same color of ink are disposed at a constant same-color nozzle pitch NP, color printing can be easily controlled to achieve a constant print resolution.

Furthermore, because a line head 100 capable of ejecting plural colors of ink can be configured with a single nozzle row 112, the first and second embodiments of the invention described above enable configuring a line inkjet printer with a simple construction.

Embodiment 3

Figure 12A:
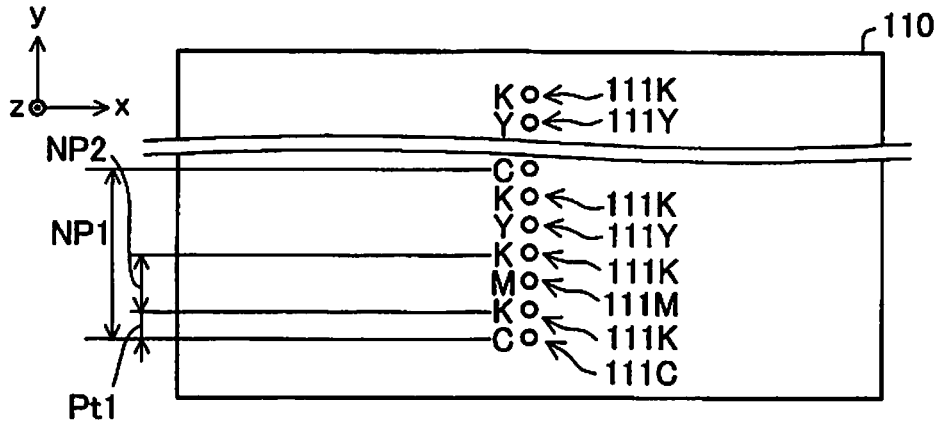
Figure 12B:
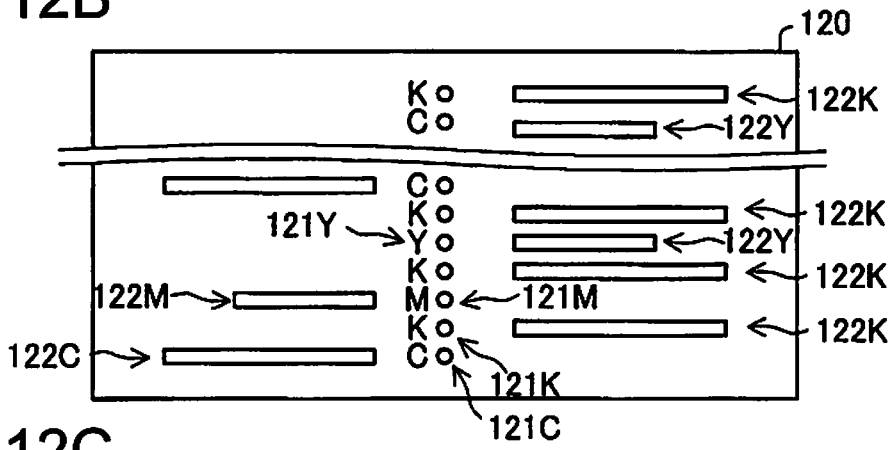
Figure 12C:
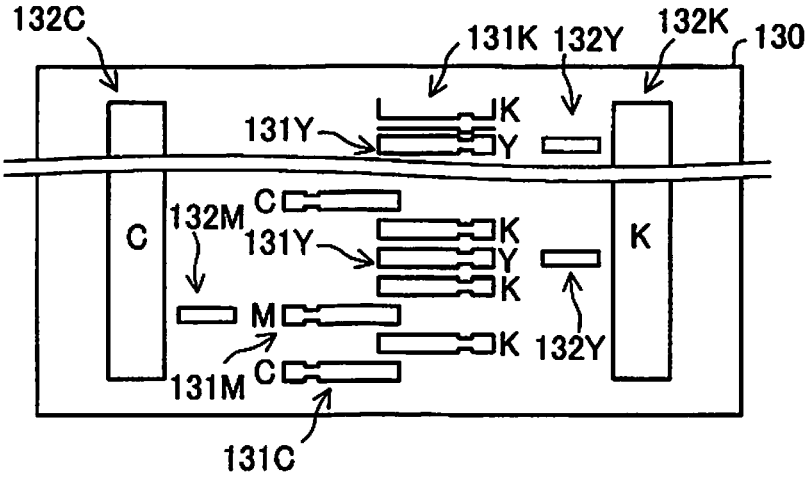
Figure 13A:
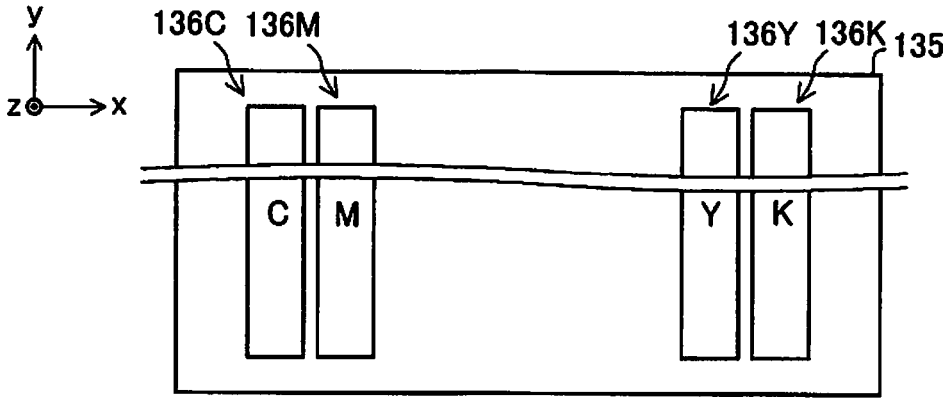
Figure 13B:
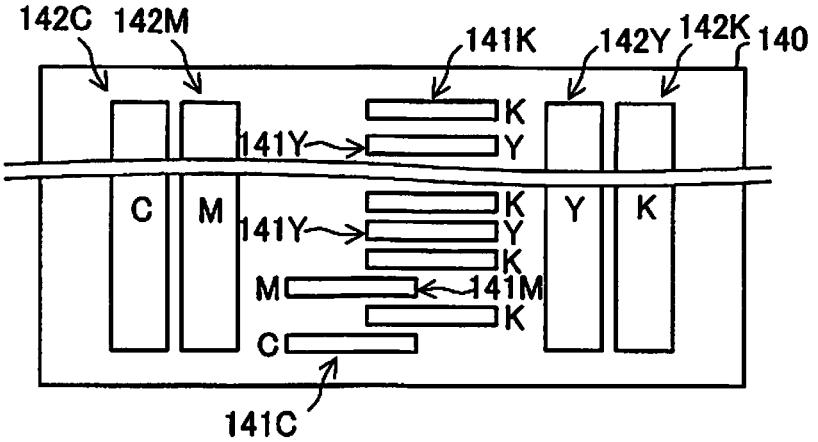
Figure 13C:
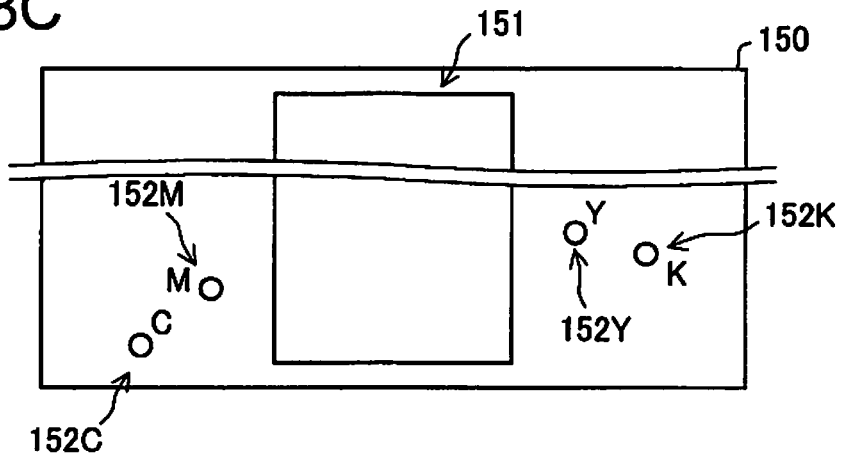

FIGS. 12A to 12C describe the first substrate 110, second substrate 120, and third substrate 130 in a third embodiment of the invention, and FIGS. 13A to 13C describe the fourth substrate 135, fifth substrate 140, and sixth substrate 150 in the third embodiment. The difference with the second embodiment described above is the number and arrangement of the nozzles 111C, 111M, 111Y, 111K. In the third embodiment, there are more blank ink nozzles 111K than other chromatic color inks (cyan ink, magenta ink, yellow ink), and the black ink nozzles 111K are formed at t smaller same-color nozzle pitch NP2. In the example in FIG. 12A, the same-color nozzle pitch NP2 of the ink nozzles 111K is 2×Pt1, and ⅓ the same-color nozzle pitch NP1 of the chromatic color ink nozzles 111C, 111M, 111Y. Note that the constant same-color nozzle pitch NP2 may contain some error (tolerance) for machining precision, or deviation of a degree not affecting print quality.

Because the nozzles 111K (black nozzles, black nozzle group) are disposed at a shorter same-color nozzle pitch NP2 than the other nozzles 111C, 111M, 111Y ejecting chromatic color inks (same-color nozzle groups ejecting the same color of ink), the configuration of the third embodiment of the invention can improve the quality of black printing.

Embodiment 4

Figure 14A:
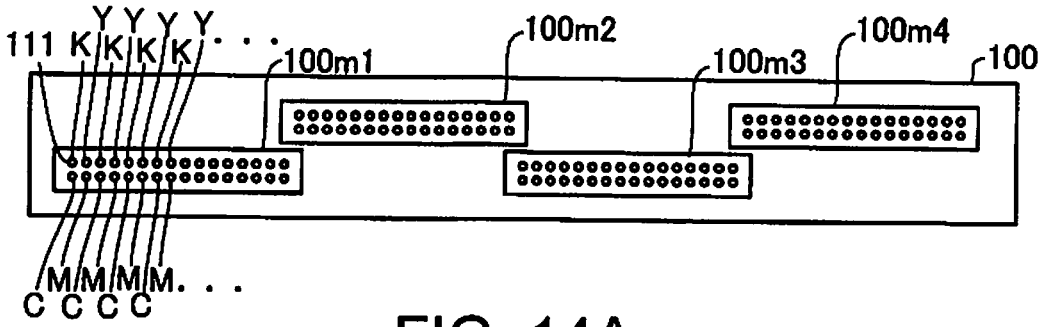
FIGS. 14A and 14B show an example of the configuration of a line head using multiple head unit modules.
Figure 14B:
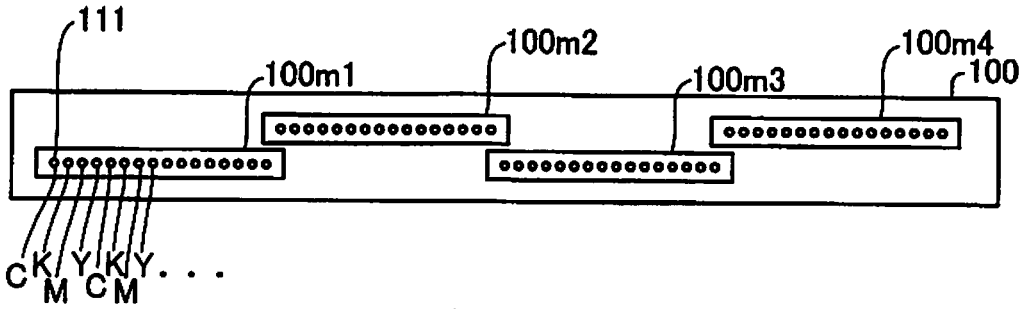

FIGS. 14A and 14B describe the configuration of a line head 100 configured with multiple head unit modules 100*m*1 to 100*m*4. The first to third embodiments described above configure the line head 100 with one head module, but the line head 100 may be configured with multiple head unit modules 100*m*1 to 100*m*4 as shown in FIGS. 14A and 14B. FIG. 14A shows an example in which each of the head unit modules 100*m*1 to 100*m*4 is configured with two nozzle rows. In this example, the line head 100 is configured with multiple head unit modules 100*m*1 to 100*m*4 disposed to mutually offset positions in the head width direction. Each of the head unit modules of the multiple head unit modules 100*m*1 to 100*m*4 is configured similarly to the line head in the first embodiment, that is, with two nozzle rows configured in a line in the head width direction, the two nozzle rows ejecting mutually different colors of ink, and at least one nozzle row of the two nozzle rows ejecting multiple different colors of ink.

FIG. 14B shows an example in which each of the head unit modules 100*m*1 to 100*m*4 is configured with one nozzle row. More specifically, the line head 100 is configured with multiple head unit modules 100*m*1 to 100*m*4 disposed to mutually offset positions in the head width direction. Each of the head unit modules of the multiple head unit modules 100*m*1 to 100*m*4 is configured with one row of nozzles in a line in the head width direction. The arrangement of these nozzle rows may be the same as the arrangement of the nozzle rows in the second embodiment or the third embodiment.

When the line head 100 is configured with one head module, and paper 500 of an A4 size, for example, is printed with one head module, the length of the nozzle rows disposed in the width direction must be approximately 210 mm. However, as shown in FIGS. 14A and 14B, if four head unit modules 100*m*1 to 100*m*4 are used, the length of the nozzle rows of each head unit module 100*m*1 to 100*m*4 in the width direction is only approximately 53 mm, which is advantageous in terms of the manufacturing precision and cost of the line head 100.

The first to fourth embodiments describe examples printing with four colors, but may be configured with N colors of ink (where N is an integer of 2 or more). The N same-color nozzle groups ejecting N different colors of ink are arrayed at the same constant same-color nozzle pitch. A nozzle group refers to a group of nozzles ejecting the same color of ink. By disposing the N same-color nozzle groups with the nozzles at the same constant same-color nozzle pitch, color printing is possible using a simple construction. In this case, the constant same-color nozzle pitch may contain some error (tolerance) for machining precision, or deviation of a degree not affecting print quality. Furthermore, the order in which the nozzle colors are arranged in the width direction described in the first to fourth embodiments is for example only, and the invention is not limited to the color order described above.

Other Embodiments

The foregoing embodiments are described using the example of a line inkjet printer 10, but the line head 100 may also be used, for example, in a receipt printer for printing receipts, or a tape writer for printing on label tape having an adhesive side for applying labels to an object, for example.

Figure 15:
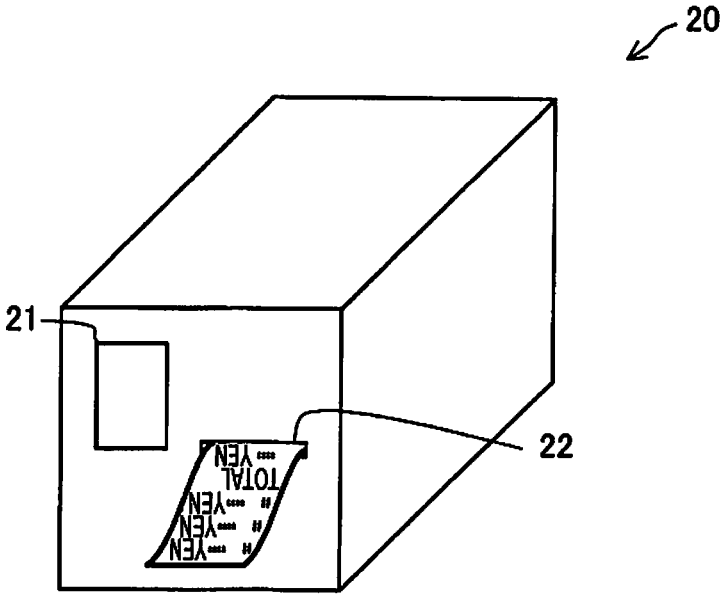
FIG. 15 shows an example of a receipt printer.

FIG. 15 shows an example of a receipt printer 20. The receipt printer 20 includes an operating unit 21 and a receipt exit 22.

Figure 16:
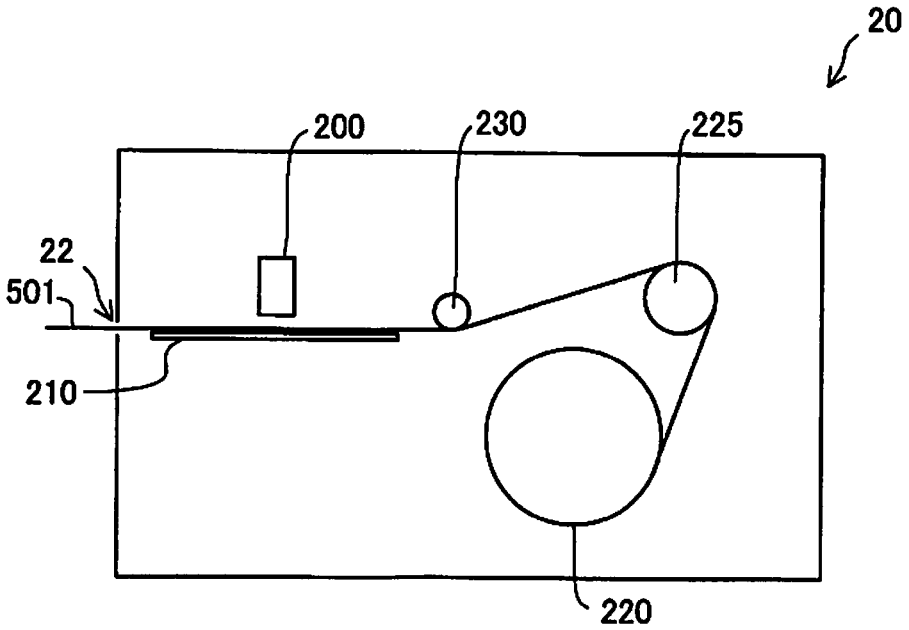
FIG. 16 schematically illustrates the configuration of a receipt printer.

FIG. 16 schematically illustrates the configuration of a receipt printer 20. The receipt printer 20 has a line head 200, platen 210, roll paper roller 220, and conveyance rollers 225, 230. The line head 200 is configured using a line head 100 according to any of embodiments 1 to 4 above. However, the length of the line head 200 is narrowed according to the width of the roll paper 501. As a result, the line head 200 can be used in a receipt printer 20. The line inkjet printer may therefore be configured as a receipt printer 20. The line head 200 is also not limited to use in receipt printers 20, and may be used in a photo printer. By using a line head according to the invention, a receipt printer or photo printer capable of color printing can be configured with a simple construction.

Figure 17:
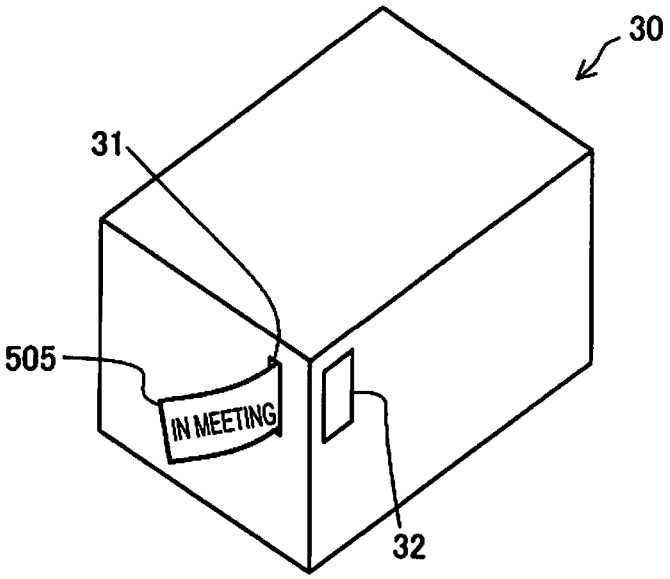
FIG. 17 illustrates a tape writer.

FIG. 17 shows an example of a tape writer 30. The tape writer has a tape exit 31, and a cutter button 32. The cutter button 32 is for cutting the discharged tape.

Figure 18:
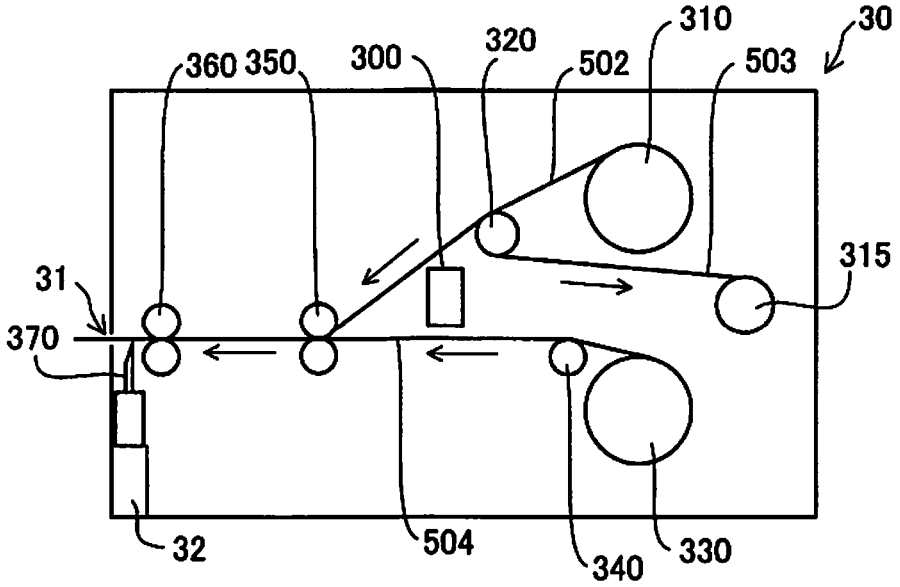
FIG. 18 schematically illustrates the configuration of a tape writer.

FIG. 18 schematically illustrates the configuration of a tape writer 30. The tape writer 30 has a line head 300, adhesive paper roller 310, take-up roller 315, tape roller 330, conveyance rollers 320, 340, 350, 360, and cutter 370. The adhesive paper roller 310 delivers adhesive tape 502 (also referred to as simply tape 502) having a protective liner 503. An adhesive layer forming an adhesive surface is formed on both sides of the adhesive tape 502. The protective liner 503 is applied over the adhesive surface. The take-up roller 315 rewinds the protective liner 503 peeled from one side of the tape 502. The conveyance roller 320 peels the protective liner 503 from one side of the tape 502 while conveying the tape 502. The conveyance roller 340 conveys printing tape 504 delivered from the tape roller 330 toward the line head 300. The printing tape 504 has a printing surface with an ink acceptance layer formed on one side. The line head 300 prints on the printing surface of the printing tape 504. The line head 300 is configured identically to a line head 100 described above. The conveyance roller 350 conveys the printing tape 504 to the tape exit 31 while applying the printing tape 504 to the adhesive surface of the tape 502. The conveyance roller 360 also conveys the tape 502 with the applied printing tape 504 to the tape exit 31. The cutter 370 cuts the tape 502 when the cutter button 32 is pressed. The protective liner 503 on the side of the tape 502 to which the printing tape 504 is not affixed is removed by the user when applying the tape 502 to an object. The line inkjet printer may be a tape writer. By using a line head according to the invention, a tape write capable of color printing can be easily configured, and a compact, low-cost color tape writer can be provided.

Note that the configuration of the tape writer 30 shown in FIG. 18 is for example only, and the invention can be applied to other types of tape writers. For example, the configuration of the tape writer 30 shown in FIG. 18 combines the tape 502 and printing tape 504 after printing, but a configuration that uses only a single tape having an adhesive layer formed on one side and a printing surface formed on the other side, and prints directly by the line head 300 on the printing surface of the tape may be used. Using this configuration further simplifies the configuration of the tape write because there is only one printing tape to convey and there is no need to assemble two tapes. The tape writer 30 may also have a display and keyboard for inputting text to print. This enables configuring the tape writer 30 that can be used as a stand-alone device. Furthermore, by loading the tape roll in a tape cassette, the tape writer 30 can be configured to allow easily replacing the tape.

The foregoing embodiments use the example of printing with four colors (N=4), but the number (N) of colors of ink may be four or more, including 5, 6, or more colors.

Preferred embodiments of the invention are described above, but the foregoing embodiments are used to simplify understanding the invention and should not be construed as limiting the invention. The foregoing embodiments of the invention can be varied and improved in many ways without departing from the scope of the accompanying claims, and such equivalent configurations are obviously included in the scope of the invention.

REFERENCE SIGNS LIST

10 line inkjet printer (printer)
20 receipt printer
21 operating unit
22 receipt exit
30 tape writer
31 tape exit
32 cutter button
100 line head
100*m*1, 100*m*2, 100*m*3, 100*m*4 head unit module
102C, 102M, 102Y, 102K pressure chamber
104C, 104M, 104Y, 104K flow channel
105C, 105M, 105Y, 105K fluid chamber
108 oscillator
110 first substrate
111 nozzle
111C cyan nozzle
111K black nozzle
111M magenta nozzle
111Y yellow nozzle
112CM nozzle row
112YK nozzle row
120 second substrate
121C, 121M, 121Y, 121K openings
122C, 122M, 122Y, 122K openings
130 third substrate
131C, 131M, 131Y, 131K openings
132C, 132M, 132Y, 132K openings
133C, 133M, 133Y, 133K constricted part
135 fourth substrate
136C, 136M, 136Y, 136K openings
140 fifth substrate
141C, 141M, 141Y, 141K openings
142C, 142M, 142Y, 142M openings
145C, 145M, 145Y, 145K piezoelectric actuators
150 sixth substrate
151 openings
152C, 152M, 152Y, 152K openings
160 head driver
170 platen
180 paper supply roller
185 paper conveyance rollers
190 paper cassette
195 exit tray
200 line head
210 platen
220 roll paper roller
225 conveyance roller
300 line head
310 paper roller
315 roller

320 conveyance roller
330 tape roller
340, 350, 360 conveyance roller
370 cutter
500 paper
501 roll paper
502 tape
503 protective liner
504 printing tape
DP same-color dot pitch
NP1 same-color nozzle pitch
NP2 same-color nozzle pitch
Pt nozzle pitch

The invention claimed is:

1. A line inkjet printer comprising:

a conveyance unit that, when printing, conveys at least one of a print medium and line head in a conveyance direction; and the line head having a first nozzle array in which a plurality of nozzles that are arranged in an arraying direction intersecting the conveyance direction, wherein, in the first nozzle array, regarding a first nozzle that ejects ink of a first color, a second nozzle that ejects ink of a second color which is different from the first color adjoins to the first nozzle at a first side in the arraying direction, and a third nozzle that ejects ink of a third color which is different from the first color adjoins to the first nozzle at a second side which is opposite to the first side in the arraying direction.

2. The line inkjet printer according to claim 1, wherein:

nozzles that eject ink of black color in the first nozzle array are arrayed at a first nozzle pitch, and nozzles that ejects ink of same-color other than the black color are arrayed at a second nozzle pitch that is larger than the first nozzle pitch.

3. The line inkjet printer according to claim 2, wherein:

each of nozzles that ejects ink of cyan color, nozzles that ejects ink of magenta color, and nozzles that ejects ink of yellow color is arrayed at the second nozzle pitch; and the first nozzle pitch is ⅓ of the second nozzle pitch.

4. The line inkjet printer according to claim 1, wherein:

the line head has the first nozzle array and a second nozzle array in which a plurality of nozzles are arranged in the arraying direction;

the first nozzle array and the second nozzle array eject mutually different colors of ink; and at least one of the first nozzle array and the second nozzle array ejects multiple different colors of ink.

5. The line inkjet printer according to claim 4, wherein:

the first nozzle array and the second nozzle array are disposed to mutually offset positions in the arraying direction.

6. The line inkjet printer according to claim 1, further comprising:

a head driver that drives the line head to eject ink;

the head driver causing the line head to eject ink droplets to form on the print medium large size ink dots of a size larger than a same-color nozzle pitch of respective multiple same-color nozzles.

7. The line inkjet printer according to claim 6, wherein:

the head driver is configured to perform solid printing in a plurality of colors on the print medium by causing the line head to eject ink droplets to form on the print medium the large size ink dots.

8. The line inkjet printer according to claim 1, wherein:

the line inkjet printer is a receipt printer that prints receipts.

9. The line inkjet printer according to claim 1, wherein:

the line inkjet printer is a tape writer that prints on a print medium tape having a printing surface and an adhesive surface for affixing the tape to an object.

10. The line inkjet printer according to claim 1, further comprising:

a first fluid chamber that communicates with nozzles that eject ink of the first color through first flow paths, and a second fluid chamber that communicates with nozzles that eject ink of the second color through second flow paths, wherein a length of each of the first flow paths is different from a length of each of the second flow paths.

11. The line inkjet printer according to claim 1, wherein:

the second color is the same as the third color.

12. The line inkjet printer according to claim 11, wherein:

nozzles that ejects ink of the first color and nozzles that ejects ink of the second color are alternately arranged in the first nozzle array.

13. The line inkjet printer according to claim 11, wherein:

the print head has further a second nozzle array in which a plurality of nozzles are arranged in the arraying direction, in the second nozzle array, regarding a fourth nozzle that ejects ink of a fourth color, a fifth nozzle that ejects ink of a fifth color which is different from the fourth color adjoins to the fourth nozzle at the first side, and a sixth nozzle that ejects ink of a sixth color which is different from the fourth color adjoins to the fourth nozzle at the second side, and the first nozzle array and the second nozzle array are arranged in the conveyance direction.

14. The line inkjet printer according to claim 1, wherein:

the second color is different from the third color.

15. The line inkjet printer according to claim 1, wherein:

the plurality of nozzles in the first nozzle array are positioned at the same position in the conveyance direction.

* * * * *